US010852057B2

(12) United States Patent
Singh Bal

(10) Patent No.: US 10,852,057 B2
(45) Date of Patent: Dec. 1, 2020

(54) MULTI-PURPOSE INSTANT CHILLER-HEATER APPARATUS

(71) Applicant: Sarandev Singh Bal, Kuala Lumpur (MY)

(72) Inventor: Sarandev Singh Bal, Kuala Lumpur (MY)

( * ) Notice: Subject to any disclaimer, the term of this patent is extended or adjusted under 35 U.S.C. 154(b) by 0 days.

(21) Appl. No.: 16/073,797

(22) PCT Filed: Oct. 3, 2017

(86) PCT No.: PCT/MY2017/000033
§ 371 (c)(1),
(2) Date: Jul. 29, 2018

(87) PCT Pub. No.: WO2018/066998
PCT Pub. Date: Apr. 12, 2018

(65) Prior Publication Data

US 2019/0219327 A1 Jul. 18, 2019

(30) Foreign Application Priority Data

Oct. 6, 2016 (MY) ..... PI 2016703685

(51) Int. Cl.
*B67D 3/00* (2006.01)
*F25D 31/00* (2006.01)
*B67D 7/80* (2010.01)

(52) U.S. Cl.
CPC ..... *F25D 31/002* (2013.01); *B67D 3/00* (2013.01); *B67D 3/0009* (2013.01); *B67D 3/009* (2013.01);
(Continued)

(58) Field of Classification Search
CPC .. B67D 3/0009; B67D 3/0022; B67D 3/0083; B67D 3/00; B67D 3/009; F25D 2331/811; F25D 2303/081; F25D 3/08
(Continued)

(56) References Cited

U.S. PATENT DOCUMENTS 662,168 A * 11/1900 Emerick ..... B67D 1/0857 165/154
719,212 A * 1/1903 Guttenberg ..... F25D 23/12 222/108
(Continued)

FOREIGN PATENT DOCUMENTS

GB 2475244 A * 5/2011 ..... F25D 3/08

*Primary Examiner* — Charles Cheyney
(74) *Attorney, Agent, or Firm* — Maschoff Brennan

(57) ABSTRACT

The present disclosure relates to a multi-purpose instant chiller-heater apparatus (100) having a housing (102) with a top portion, a bottom portion and a number of side portions. The multi-purpose instant chiller-heater apparatus (100) further includes a hollow tube structure (104) positioned within the housing (102) for passing the liquid to be heated or cooled through it. The hollow tube structure (104) is provided with an inlet (112) at one end of the hollow tube structure (104) for receiving the liquid and an outlet (114) at another end of the hollow tube structure (104) for providing chilled or heated liquid. The housing (102) is configured to store a heating or cooling means to heat or cool the liquid passing through the hollow tube structure (104) positioned inside the housing (102). The housing (102) is provided with an insulator layer for preventing heat exchange between its interior and exterior. The liquid passing through the hollow tube structures (104) inside the housing (102) is cooled or heated to a desired temperature and is discharged through the outlet (114) of the housing (102).

6 Claims, 4 Drawing Sheets

(52) U.S. Cl.
CPC ..... *B67D 3/0022* (2013.01); *B67D 3/0083* (2013.01); *B67D 7/80* (2013.01); *F25D 31/005* (2013.01); *F25D 2331/811* (2013.01)

(58) Field of Classification Search
USPC ..... 222/146.6, 185.1, 608; 62/399
See application file for complete search history.

(56) References Cited

U.S. PATENT DOCUMENTS 1,591,623 A * 7/1926 Hassensall ..... B67D 3/00 222/146.6
1,662,267 A * 3/1928 Horner ..... F25D 3/02 62/391
1,832,798 A * 11/1931 Taylor ..... A47J 41/0072 220/DIG. 1
2,210,256 A * 8/1940 Potocek ..... F25D 31/002 165/115
4,204,613 A * 5/1980 Terzian ..... B67D 3/0009 165/163
4,407,356 A * 10/1983 DeLau ..... B67D 3/00 126/261
4,599,872 A * 7/1986 Rist ..... B67D 3/0009 62/399
7,117,685 B2 * 10/2006 Wetherbee ..... B67D 3/0009 62/115
7,350,671 B2 * 4/2008 Mika ..... B67D 3/0009 222/129
8,640,748 B2 * 2/2014 Chera ..... B67D 3/0009 141/234
9,357,874 B2 * 6/2016 Licare ..... A47J 31/462
10,106,395 B2 * 10/2018 Paskert ..... B67D 3/0032
2004/0195262 A1 * 10/2004 Hart ..... B67D 3/0009 222/1
2018/0216875 A1 * 8/2018 Caswell ..... B67D 3/0009

* cited by examiner

MULTI-PURPOSE INSTANT CHILLER-HEATER APPARATUS

FIELD OF INVENTION

The present invention relates generally to cooling and heating apparatus, and more specifically, to a multi-purpose cooling and heating apparatus for chilling and heating of liquids.

BACKGROUND

There are numerous events and activities where one desires to enjoy cool beverages. However, many such events and activities are located in places where there is no access to cool beverages chilled by traditionally means such as refrigerators. In particular, remote locations such as on the golf courses, sporting events, outdoor concerts and other outdoor activities, do not facilitate the easy distribution of cool beverages. Easy distribution of cool beverages is also desirable at resorts, bars and restaurants. Most consumers at these activities desire cool beverages. Numerous means have been developed to provide such beverages. Beverage coolers or chillers are widely used in such places households, commercial places such as bars, restaurants and offices. Such chillers commonly consist of a receptacle for a beverage and refrigerating means, which is operated by electricity or natural gas. The coolers are generally quite heavy because of the weight of the refrigerating means and the beverage receptacle and for that reason are not portable. They are also, of course, not suitable for use where there is not a source of power such as outdoors. Certain beverages are highly sensitive to temperature, which can affect their appeal, both in taste and appearance. Beer, for example, is most flavorful and visually appealing when drunk in a narrow temperature range of from about 1° to 5° C. When beer is dispensed or poured directly from a refrigerated container, maintenance of the ideal drinking temperature presents no real problems.

The most typical manner to provide cool beverages at remote locations is to transport canned beverages in coolers containing ice and distribute the canned beverages at the remote location. If the contents are not consumed, the content may go stale. Also, there's a chance of contamination because of handling by bare hands. Also, the cans or bottles are kept in an ice box, in which the ice melts quickly due to regular opening of the lids to retrieve the bottles or cans, and thereby requiring more ice to cool cans or bottles. Further, the use of individual cans or bottles reduces the volume of beverage one is able to transport to such remote locations since the can packaging occupies the limited cooler space.

U.S. Pat. No. 4,225,059 describes a portable beverage cooler and dispenser. The apparatus includes an air cylinder for pressurizing beer kegs. The beer kegs are located in a housing. The beer kegs are connected to a coiled dispensing hose also located in the housing. The hose passes through ice located in ice chambers. This serves to cool the beer before it is dispensed through spigots at the top of the apparatus. In addition, U.S. Pat. No. 2,223,152 describes a stationary beer cooling device. The device is not pressurized. The device cools the beer by circulating it through a cooling coil which is immersed in an ice water bath. The cooling coil is protected by a perforated metal sleeve so as to permit an operator to agitate the ice bath with a stick or a rod.

The patent application US 20070084233 A1, entitled "Beverage cooler" discloses a beverage cooler that includes a vessel for a coolant such as ice water or a conventional coolant such as glycol or Freon. A coil is mounted in the interior of the vessel. The coil is made up of a number of vertically spaced joined circles, which are spaced apart from each other and from the interior wall of the vessel. The coil has an inlet through which a beverage from an external source, separate and apart from the cooler, enters the coil. A drain located above the coil carries off excess coolant. A tap at the outlet of the coil controls the flow of the beverage from the coil. However, the cooler cannot be used for heating and other purposes.

US patent application U.S. Pat. No. 6,502,415 B2 further discloses an apparatus is provided for cooling a carbonated beverage stored in a container and dispensing non-foamed carbonated beverage. A method of cooling and delivering non-foamed beverage with the apparatus is also provided. The beverage is preferably beer. The apparatus comprises a housing that has a number of chambers. A chamber can optionally be provided for receiving a number of beer kegs. A pressurizing device is attached to a beer keg for maintaining the beer under pressure in the keg. A conduit is received in one of the chambers and communicates between the beer keg and a tap located on the exterior of the apparatus. A water and ice cooling mixture is circulated over the conduit in the same chamber for cooling the conduit. A perforated vessel surrounds the conduit to protect the conduit and the agitators from being damaged by ice particles. At least two agitators for circulating the cooling fluid over the conduit are located in chamber where the conduit is received. The agitators are positioned to continuously circulate cold water over the conduit for maximum heat exchange.

Hence there exists a need for an instant heater or cooler apparatus that is self-sufficient so that it can be used where there is no source of power. The needed apparatus would be compact, scalable, easy to maintain and operate, can be used for heating and cooling without structural modifications, etc.

SUMMARY

The present disclosure relates to a multi-purpose instant chiller-heater apparatus capable of providing heating and cooling services for a variety of applications. The present multi-purpose instant chiller-heater apparatus includes a housing having a top portion, a bottom portion and a number of side portions. The housing is provided with an insulator layer in the wall surfaces for preventing heat exchange between an interior and exterior of the multi-purpose instant chiller-heater apparatus. The multi-purpose instant chiller-heater apparatus further includes one or more hollow tube structures positioned within the housing for passing the liquid to be heated or cooled through it. The hollow tube structure is arranged in a helix or other suitable form inside the housing of the multi-purpose instant chiller-heater apparatus. The hollow tube structure is provided with an inlet at one end of the hollow tube structure for receiving the liquid to be heated or cooled and to pass through the helix shape or other suitable form of the hollow tube structure. The hollow tube structure is further provided with an outlet at another end of the hollow tube structure for providing chilled or heated liquid from the hollow tube structure for external use. The hollow tube structure may contain a rod within which may be connected to a cooling or heating source to enhance the cooling or heating function of the hollow tube structure. The housing is configured to store a heating or cooling means to heat or cool the liquid passing through the hollow tube structure positioned inside the housing. The liquid passing through the hollow tube structures inside the housing is cooled or heated to a desired temperature and is discharged through the outlet of the housing.

Other objects and advantages of the embodiments herein will become readily apparent from the following detailed description taken in conjunction with the accompanying drawings.

BRIEF DESCRIPTIONS OF THE DRAWINGS

Figure 3:
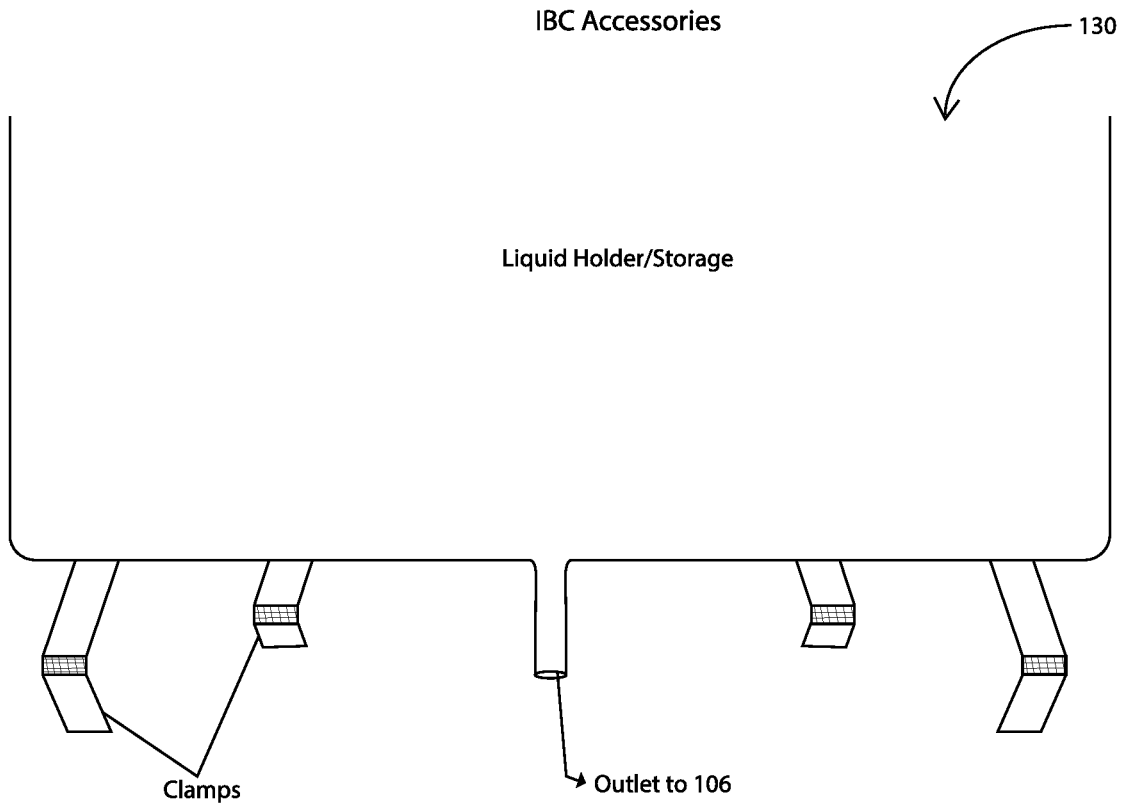
Figure 4:
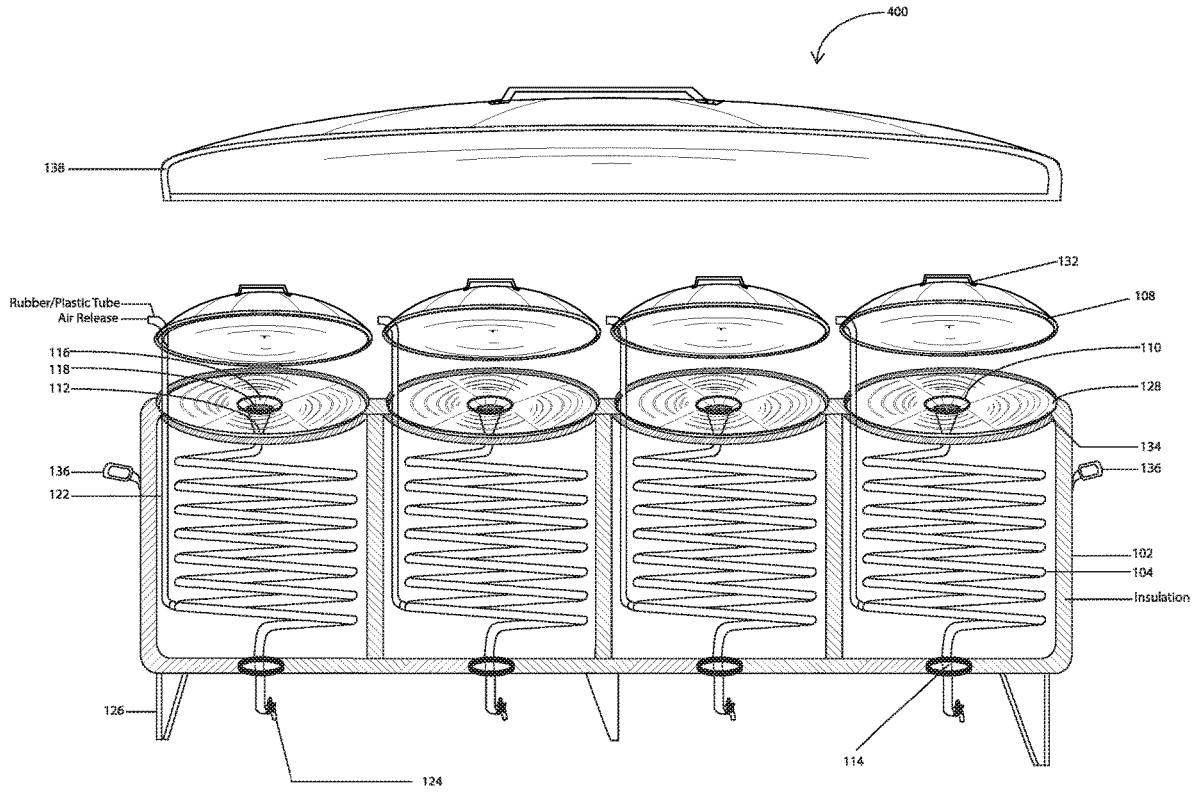

FIG. 3 illustrates the use of an accessory with the multi-purpose instant chiller-heater apparatus for heating and cooling beverages, according to an embodiment of the present invention; and FIG. 4 illustrates the multi-purpose instant chiller-heater apparatus with multiple hollow tube structures for both heating and/or cooling large quantities and/or different types of beverages, according to an embodiment of the present invention.

DETAILED DESCRIPTION

In the following detailed description, a reference is made to the accompanying drawings that form a part hereof, and in which the specific embodiments that may be practiced is shown by way of illustration. These embodiments are described in sufficient detail to enable those skilled in the art to practice the embodiments and it is to be understood that the logical, mechanical, structural and other changes may be made without departing from the scope of the embodiments. The following detailed description is therefore not to be taken in a limiting sense.

Figure 1:
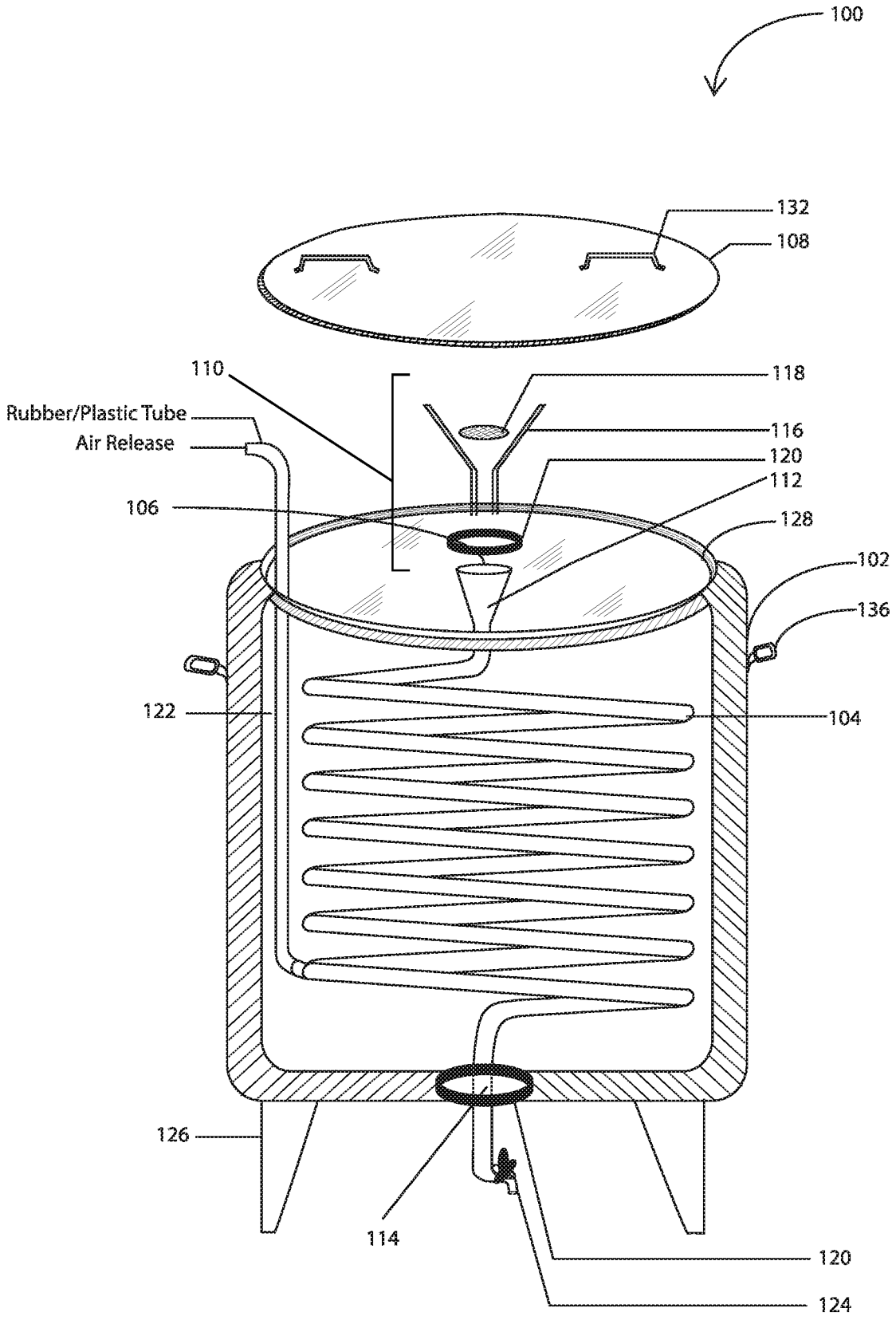
FIG. 1 illustrates a multi-purpose instant chiller-heater apparatus capable of providing heating and cooling services for a variety of applications, according to a preferred embodiment of the present invention.

FIG. 1 illustrates a multi-purpose instant chiller-heater apparatus (100) capable of providing heating and cooling services for a variety of applications, according to a preferred embodiment of the present invention. The present multi-purpose instant chiller-heater apparatus (100) can be utilized by a number of users for delivering chilled or hot liquid, such as, but not limited to, chilled or hot water at a desired location. The multi-purpose instant chiller-heater apparatus (100) can be used for household, public and industrial applications and is easy and inexpensive to maintain and operate. The present multi-purpose instant chiller-heater apparatus (100) includes a housing (102) having a top portion, a bottom portion and a number of side portions. According to an embodiment of the present invention, the multi-purpose instant chiller-heater apparatus (100) has a rectangular shape, however the shape and size of the multi-purpose instant chiller-heater apparatus (100) can be varied depending upon the requirement and application. The housing (102) is provided with an insulator layer for preventing heat transfer or heat exchange from an interior of the multi-purpose instant chiller-heater apparatus (100). The housing (102) is made from a metallic or non-metallic rigid material, capable of preventing heat exchange between the interior and the exterior of the housing (102). In some instances, the housing (102) has a first layer disposed interior to the housing (102) and a second layer at an exterior of the housing (102). The insulating material is placed in between the first layer and the second layer of the housing (102) thereby preventing the heat exchange between the interior and exterior of the housing (102).

The present multi-purpose instant chiller-heater apparatus (100) further includes a hollow tube structure or a passage (104) positioned within the housing (102) for passing a liquid to be heated or cooled through it. In an embodiment, the hollow tube structure or passage (104) is collapsible together with the housing (102) thus making whole of the apparatus (100) collapsible. In an embodiment, the passage (104) is a collapsible tube with concentric modular pipes that fit into each other. Furthermore, in yet another embodiment, the passage (104) foldable, which together with a collapsible housing make the apparatus (100) collapsible. This makes the apparatus easily portable. In yet another preferred embodiment, the hollow tube structure (104) is arranged in a helix form inside the housing (102) of the multi-purpose instant chiller-heater apparatus (100). The hollow tube structure (104) is provided with an inlet (112) at one end of the hollow tube structure (104) for receiving the liquid to be heated or cooled and to pass through the helix shape of the hollow tube structure (104). The hollow tube structure (104) is further provided with an outlet (114) at another end of the hollow tube structure (104) for providing chilled or heated liquid from the hollow tube structure (104) for external use. The housing (102) is configured to store a heating or cooling means to heat or cool the liquid passing through the hollow tube structure (104) positioned inside the housing (102). The liquid passing through the hollow tube structures (104) inside the housing (102) is cooled or heated to a desired temperature and is discharged through the outlet (114) of the housing (102).

Figure 2:
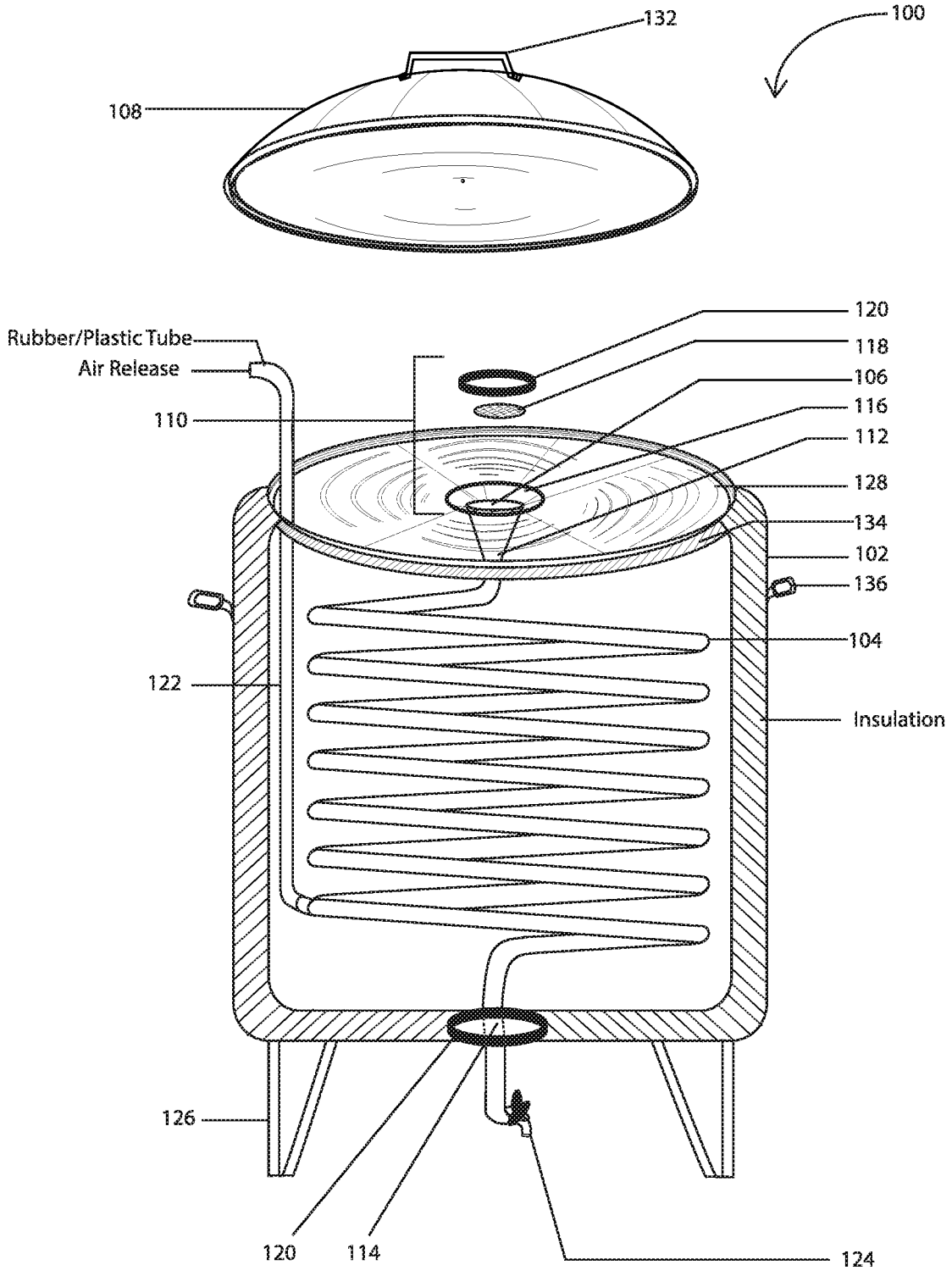
FIG. 2 illustrates an exploded view of the multi-purpose instant chiller-heater apparatus for heating and cooling beverages, according to a preferred embodiment of the present invention.

The top portion of the housing (102) is provided with a top opening (106) of desired dimensions. The top opening (106) at the top portion of the housing (102) is closed using an insulated first lid (128) and/or merely by a use of a cork or any other blocking or closing means. In an embodiment, the cork or any other blocking means is insulated. In another embodiment, the first lid (128) is not insulated. Moreover, an insulator lining (134) may be provided below the first lid (128). Furthermore, the first lid (128) may be conical in shape. The top portion of the housing (102) is provided with a top opening (106) of desired dimensions, where the top portion of the housing (102) is attached with a conical shaped lid (128) for directing liquid to the centrally positioned top opening (106). In a preferred embodiment of the present invention, as shown in FIG. 2, the insulated second lid (108) has a circular shape. However, the shape and dimensions of the insulated second lid (108) can be varied depending on the size and dimensions of the top portion of the housing (102). The second lid (108) is attached with a top handle (132) for enabling users to easily remove and place the second insulated lid (108) on the top portion of the housing (102). The top opening (106) at the top portion of the housing (102) can be closed using an insulated lid (108) as shown in FIG. 2. The conical shaped lid (128) covering the top portion of the housing (102) is further provided with an inlet structure (110) for receiving the liquid to be heated or cooled and passing the liquid through the hollow tube structure (104). The inlet structure (110) on the conical shaped lid (128) includes a conical structure (116) for receiving the liquid, a mesh arrangement (118) positioned inside the conical structure (116) for filtering the liquid received through the conical structure (116) or the top opening (106) and a rubber washer (120) for tightly and making a leak free connection of the conical structure (116)

to the inlet (112). In an embodiment, a washer is made by other suitable materials such as metal or polymer. Each component of the inlet structure (110) forming part of the conical shaped lid (128) is detachable and can be easily replaced or cleaned by the users whenever desired. In some designs, the conical shaped lid (128) is detachable from the housing (102). The insulated lid (108) and the conical shaped lid (128) can be clamped or screwed or threaded to the housing (102) or can be attached air-tight with the housing (102), thereby preventing heat exchange between the interior of the housing (102) and the exterior.

The liquid received through the inlet structure (110) on top of the conical shaped lid (128) is then passed through the hollow tube structure (104) through its inlet (112). The bottom portion of the housing (102) of the present multi-purpose instant chiller-heater apparatus (100) is connected to an external valve or tap (124) for allowing users to collect a desired amount of liquid through it. The outlet (114) at the end of the hollow tube structure (104) is connected to the external valve (124) for allowing the users to collect the desired quantity of chilled or heated liquid. The housing (102) of the present multi-purpose instant chiller-heater apparatus (100) is further filled with a heating or cooling means, which is in contact with the hollow tube structure (104) and in some instances the inner rod for transferring the heat between the heating or cooling means and the liquid passing through the hollow tube structure (104). The hollow tube structure (104) and the inner rod of the present multi-purpose instant chiller-heater apparatus (100) is made from materials such as steel or copper or any other materials, which is capable of transferring the heat from the heating or cooling means stored in the interior of the housing (102) of the present multi-purpose instant chiller-heater apparatus (100).

The multi-purpose instant chiller-heater apparatus (100) of the present embodiment further includes a tube arrangement (122) positioned within the housing (102). The tube arrangement (122) positioned within the housing (102) connects the hollow tube structure (104) to the outside environment. The tube arrangement (122) connecting the hollow tube structure (104) to the outside environment releases excess air inside hollow tube structure (104) to the outside environment. The tube arrangement (122) for releasing the excess air inside the hollow tube structure (104) is connected to the hollow tube structure (104) through a U-shaped arm portion, which is capable of collecting the air or gas trapped or produced within the interior of the hollow tube structure (104) to the external environment. The tube arrangement (122) is passed through the top portion of the housing (102), through an opening tightly sealed using rubber washers or washers of any other material, which allows the air produced inside the hollow structure (104) to escape into the external environment. The tube arrangement (122) can be made from metallic such as copper, steel or any other metallic or plastic material. In some instances, the portion of the tube arrangement (122) inside the housing (102) is made from the same material as that of the hollow tube structure (104) and the tube arrangement (122) above the housing (102) is made from plastic or rubber. Further the housing (102) of the present multi-purpose instant chiller-heater apparatus (100) is attached with clamp holding means (136), attached on the number of side portions of the housing (102), for easily carrying or lifting the multi-purpose instant chiller-heater apparatus (100) during maintenance and transportation. The clamp means (136) holds the first lid and/or the conical shaped lid (128) in position, when closed. The clamp holding means (136) may also be used to attach a sling or a belt or any other hanging means that allows a user to carry the instant chiller-heater apparatus. The clamp (136) may also be used to attach or hang accessories.

The outlet (114) at the end of the hollow tube structure (104) is connected to an external valve (124) for allowing the users to collect a desired quantity of chilled or heated liquid from the multi-purpose instant chiller-heater apparatus (100). The bottom portion of the housing (102) is attached with a number of foldable, detachable stands (126) for supporting the multi-purpose instant chiller-heater apparatus (100). In some instances, the stands (126) are configured to attach with a number of casters for easily transporting the multi-purpose instant chiller-heater apparatus (100) to a desired location. The present multi-purpose instant chiller-heater apparatus (100) can be attached with a variety of accessories, which includes, but not limited to, a liquid storage tank as shown in FIG. 3, heating and/or cooling means, which is capable of performing rapid heating or cooling with the help of external power sources or any other external arrangements, a variety of electronic monitoring, measuring, indication and control means that can be used to monitor the operation of the present multi-purpose instant chiller-heater apparatus (100), measure the parameters such as quantity, temperature etc., providing visual and audible indications, enabling automated, semi-automated or manual control of the operation of the present multi-purpose instant chiller-heater apparatus (100), and multiple holders to place drink containers etc. FIG. 3 shows the use of a liquid storage accessory with the present multi-purpose instant chiller-heater apparatus (100). The liquid storage accessory (130) can be placed anywhere at a level above the top portion of the housing (102). The liquid storage accessory (130) has clamps (134) for placing it at a position above the present multi-purpose instant chiller-heater apparatus (100) and an outlet that can be attached or directed to the conical structure (116) at the inlet structure (110) on top of the conical shaped lid (128) or may be attached directly to the inlet (112)

Further the present multi-purpose instant chiller-heater apparatus (100) can be configured to use with a number of hollow tube structures (104) for heating and/or cooling large quantities and/or different types of liquid, as shown in FIG. 4. The housing (102) can be configured to install with the number of hollow tube structures (104) having a number of inlets (112) for receiving the liquid and a number of outlets (114) for delivering the heated and/or chilled liquid. The hollow tube structures (104) can be arranged in-line, parallel, vertically, or in any mixed fashion for heating and cooling large qualities of liquid according to alternate embodiment of the present invention. The present multi-purpose instant chiller-heater apparatus (100) can be used as a multiple beverage chiller and/or heater in household, commercial, industrial and other applications and is simple in construction and operation. Each compartment of the multi-purpose instant chiller-heater apparatus (400) as in FIG. 4 are separated using the insulated walls to prevent heat exchange. This also enables the use of the compartments of the multi-purpose instant chiller-heater apparatus (400) for different applications such as, but not limited to heating and cooling applications in adjacent compartments for different types of liquids. The apparatus (400) may be covered using another lid (138) as shown in FIG. 4. The housing (102), the insulated conical shaped lid (128) and the insulated lid (108) completely seals off the interior of the housing (102) and prevents heat from exchanging between the external environment and the interior of the housing (102) thereby making the apparatus (400) efficient and can be widely used in many industries for efficient heating and cooling of beverages. In an embodiment, all the parts or the components including hollow tube structure (104) of the instant heater-chiller apparatus mentioned herein, in FIGS. 1, 2, and 4, or their other representations, are detachable or easily replaceable.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the scope of the appended claims.

Although the embodiments herein are described with various specific embodiments, it will be obvious for a person skilled in the art to practice the invention with modifications. However, all such modifications are deemed to be within the scope of the claims.

I claim:

1. A multi-purpose instant chiller-heater apparatus for heating and/or cooling of a liquid comprises:

a housing having a top portion, a bottom portion and a plurality of side portions;

one or more hollow tube structure positioned within the housing for passing a liquid there through, wherein the hollow tube structure is arranged in a helix form;

a handle attached to the housing and arranged for lifting or carrying of the multi-purpose instant chiller-heater apparatus;

wherein the hollow tube structure is provided with one or more inlet provided at one end of the hollow tube structure for receiving the liquid and to pass through the hollow tube structure;

the housing is configured to store a heating or cooling means to heat or cool the liquid passing through the hollow tube structure; and the hollow tube structure is further provided with one or more outlet at another end of the hollow tube structure such that the liquid passing through the hollow tube structure inside the housing is cooled or heated to a desired temperature and is discharged through the outlet of the housing;

the top portion of the housing is provided with a top opening of desired dimensions, the top opening fluidly connected with the one or more inlet to the hollow tube structure;

wherein the top portion of the housing is attached with an insulated first lid for directing liquid to the top opening and into the hollow tube structure, wherein the top opening at the top portion of the housing is closed using a second lid;

the housing configured to install a plurality of hollow tube structures having a singular or plurality of inlets for receiving a plurality of different liquids, and a singular or plurality of outlets for delivering a plurality of heated and/or chilled liquid simultaneously;

the housing includes a tube arrangement connecting the hollow tube structure to an outside environment, wherein the tube arrangement releases excess air or gas inside the hollow tube structure to the outside environment, wherein the tube arrangement is connected to the hollow tube structure through a U-shaped arm portion which is capable of collecting the excess air or gas trapped or produced within an interior of the hollow tube structure to the outside environment, and wherein the tube arrangement linked to the U-shaped arm portion is positioned at the bottom portion.

2. The multi-purpose instant chiller-heater apparatus of claim 1 wherein the housing is provided with an insulator layer for preventing heat exchange between an interior of the multi-purpose instant chiller-heater apparatus and an exterior.

3. The multi-purpose instant chiller-heater apparatus of claim 1 wherein the insulated first lid covering the top portion of the housing is provided with an inlet structure for receiving a liquid and passing through the hollow tube structure.

4. The multi-purpose instant chiller-heater apparatus of claim 3 wherein the inlet structure comprises:

a conical structure for receiving the liquid;

a mesh arrangement positioned inside the conical structure for filtering the liquid received through the conical structure; and a washer for tightly connecting the conical structure to the insulated first lid and/or top opening.

5. The multi-purpose instant chiller-heater apparatus of claim 1 wherein the outlet at the end of the hollow tube structure is connected to an external tap for allowing a plurality of users to collect a desired quantity of chilled or heated liquid.

6. The multi-purpose instant chiller-heater apparatus of claim 1 wherein the bottom portion of the housing is attached with a plurality of foldable, detachable stands for supporting the multi-purpose instant chiller-heater apparatus.

* * * * *